US009772145B2

(12) United States Patent
Ito

(10) Patent No.: US 9,772,145 B2
(45) Date of Patent: Sep. 26, 2017

(54) FLAT PLATE HEAT EXCHANGER HAVING FLUID DISTRIBUTOR INSIDE MANIFOLD

(75) Inventor: Daisuke Ito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 267 days.

(21) Appl. No.: 14/124,324

(22) PCT Filed: Jun. 24, 2011

(86) PCT No.: PCT/JP2011/064580

§ 371 (c)(1),
(2), (4) Date: Dec. 6, 2013

(87) PCT Pub. No.: WO2012/176336

PCT Pub. Date: Dec. 27, 2012

(65) Prior Publication Data

US 2014/0123697 A1 May 8, 2014

(51) Int. Cl.
*F28F 9/02* (2006.01)
*F28F 3/08* (2006.01)
(Continued)

(52) U.S. Cl.
CPC ..... *F28F 3/08* (2013.01); *F28D 9/005* (2013.01); *F28F 9/0273* (2013.01); *F28F 13/06* (2013.01);
(Continued)

(58) Field of Classification Search
CPC .. F28D 9/005; F28D 2021/007; F28D 9/0037; F28D 2021/0071; F28F 13/06;
(Continued)

(56) References Cited

U.S. PATENT DOCUMENTS 2,357,156 A * 8/1944 Wilson ..... F28D 1/05325 165/142
2,648,527 A * 8/1953 Carnahan ..... F28D 9/005 165/167
(Continued)

FOREIGN PATENT DOCUMENTS

CN 1094156 A 10/1994
CN 2572309 Y 9/2003
(Continued)

OTHER PUBLICATIONS

Takeshi et al.—JP-2006200852A Mar. 8, 2006—English Machine Translation.*
(Continued)

*Primary Examiner* — Etsub Berhanu
*Assistant Examiner* — Jose O Class-Quinones
(74) *Attorney, Agent, or Firm* — Posz Law Group, PLC

(57) ABSTRACT

A plate heat exchanger that evenly distributes an inflowing fluid to heat exchange channels located within the plate heat exchanger. The plate heat exchanger includes a fluid distributor in order to evenly distribute the inflowing fluid throughout the heat exchange channels. The fluid distributor includes protruding resistors that decrease in size as each protruding resistor is located further away from the inflowing fluid inlet of the fluid distributor.

13 Claims, 9 Drawing Sheets

(51) Int. Cl.
*F28F 13/06* (2006.01)
*F28D 9/00* (2006.01)
*F28D 21/00* (2006.01)

(52) U.S. Cl.
CPC ..... *F28D 2021/007* (2013.01); *F28D 2021/0071* (2013.01)

(58) Field of Classification Search
CPC ..... F28F 3/08; F28F 9/0273; F28F 9/0212; F28F 9/0204; F28F 2009/226; F28F 3/086; F28F 9/0224; F28F 9/0202; F28F 9/0278; F25B 39/028
USPC ..... 165/174, 166, 167, 175, 916; 62/525
See application file for complete search history.

(56) References Cited

U.S. PATENT DOCUMENTS 2,710,443 A * 6/1955 Webb ..... B23K 9/0288 188/77 R
3,731,734 A * 5/1973 Ris ..... F28B 1/06 165/100
4,683,121 A * 7/1987 Goudriaan ..... B01J 8/06 422/311
4,705,103 A * 11/1987 Zogg ..... F28F 1/40 165/110
6,179,051 B1 * 1/2001 Ayub ..... F28D 9/005 137/561 A
2003/0010483 A1 * 1/2003 Ikezaki ..... F28F 3/083 165/174
2003/0094270 A1 * 5/2003 Holm ..... F28D 9/005 165/166
2003/0116310 A1 * 6/2003 Wittmann ..... F28F 9/0273 165/153
2004/0011514 A1 * 1/2004 Holm ..... F28D 9/005 165/166
2006/0032242 A1 * 2/2006 TeGrotenhuis ..... B01D 5/0003 62/93
2006/0101849 A1 * 5/2006 Taras ..... F25B 39/00 62/515

FOREIGN PATENT DOCUMENTS

| | | | | |
|---|---|---|---|---|
| CN | 1611901 | A | | 5/2005 |
| JP | 02-097899 | A | | 4/1990 |
| JP | 03-244995 | A | | 10/1991 |
| JP | 05-45487 | U | | 6/1993 |
| JP | 05-264126 | A | | 10/1993 |
| JP | 07-151488 | A | | 6/1995 |
| JP | 11-101588 | A | | 4/1999 |
| JP | 2001-050611 | A | | 2/2001 |
| JP | 2001-280888 | A | | 10/2001 |
| JP | 2001-355981 | A | | 12/2001 |
| JP | 2002-062082 | A | | 2/2002 |
| JP | 2006200852 | A | * | 8/2006 |
| JP | 2008-190863 | A | | 8/2008 |
| JP | 2010-261662 | A | | 11/2010 |
| WO | 94/14021 | A1 | | 6/1994 |

OTHER PUBLICATIONS

Tanaka—JP2010261662—English Machine Translation.pdf.*
Office Action dated Aug. 18, 2015 issued in corresponding CN patent application No. 201180071866.6 (and English translation).
Office Action dated Feb. 28, 2015 issued in corresponding CN patent application No. 201180071866.6 (and English translation).
International Search Report of the International Searching Authority mailed Sep. 13, 2011 for the corresponding international application No. PCT/JP2011/064580 (and English translation).
Office Action dated May 18, 2017 issued in corresponding GB patent application No. GB1322314.4.
Office Action dated Jul. 20, 2017 issued in corresponding GB patent application No. GB1322314.4.

* cited by examiner (a) (b)

FLAT PLATE HEAT EXCHANGER HAVING FLUID DISTRIBUTOR INSIDE MANIFOLD

CROSS REFERENCE TO RELATED APPLICATION

This application is a U.S. national stage application of International Application No. PCT/JP2011/064580 filed on Jun. 24, 2011, the disclosure of which is incorporated by reference.

TECHNICAL FIELD

The present invention relates to plate-type heat exchangers.

BACKGROUND

Known types of rectifier-distributor components in plate-type heat exchangers in the related art include a type provided with small holes or slits in a main pipe so as to evenly distribute a fluid to heat exchange channels between plates in the arrangement direction of the plates, and a type in which a pipe is reduced in diameter in the flowing direction so as to reduce the cross-sectional area of the channel (e.g., see Patent Literatures 1, 2, and 3).

PATENT LITERATURE

Patent Literature 1: Japanese Unexamined Patent Application Publication No. 11-101588 (page 3, FIG. 2)

Patent Literature 2: Japanese Unexamined Patent Application Publication No. 2001-050611 (page 3, FIGS. 2 and 3)

Patent Literature 3: Japanese Unexamined Patent Application Publication No. 5-264126 (page 4, FIGS. 1 and 6)

Patent Literature 4: Japanese Unexamined Patent Application Publication No. 2001-280888 (FIGS. 1 and 3)

In the related art, when the plate-type heat exchanger is used as an evaporator through which a refrigerant (i.e., a first fluid) and water (i.e., a second fluid) flow, the first fluid (i.e., the refrigerant) flowing through an inlet hole in the arrangement direction of the plates becomes a two-phase flow. In this case, due to inertial force, a liquid tends to flow toward the rear side, thus making it difficult to evenly distribute the liquid to the heat exchange channels between the plates. Moreover, a separated flow tends to form at the inlet hole, and this flow pattern (i.e., the formation of the separated flow) may become a hindrance to the even distribution between the plates. Thus, heat exchange is not effectively performed at every plate, which is a problem in that the heat exchanging amount may decrease and that freezing may occur due to uneven gas-liquid distribution. Such phenomena prominently occur especially when there are a large number of plates.

As a countermeasure against this problem, a rectifier-distributor component is provided in the related art (such as Patent Literature 1 and Patent Literature 2). However, with the configuration in which small holes or slits are provided in the main pipe as in the related art, since there is no resistance in the arrangement direction, the fluid is not made even in the arrangement direction. Thus, the tendency of the fluid to flow toward the rear side does not change. Because the distribution holes for distributing the fluid between the plates are recessed (i.e., the main pipe is simply provided with holes) (Patent Literature 1), the fluid traveling distance in the long-axis direction of the plates is short in the channels between the plates, thus making it difficult to distribute the fluid in the short-axis direction of the plates. In addition, when assembling the plate-type heat exchanger by brazing, positioning between the distribution holes and the channels between the plates is difficult. In Patent Literature 3, the cross-sectional area of an inlet hole gradually decreases from the inlet side thereof. In this case, the speed of flow becomes higher from the inlet hole toward the rear side. Therefore, in the case of a large number of channels, such as 100 stacked plates and 50 channels, the tendency of a liquid to flow less at the front side does not change. In Patent Literature 4, a hollow member 21 is used, as shown in FIG. 3 in Patent Literature 4. However, even with the use of the hollow member 21, the tendency of a liquid to flow less at the front side still remains, as in the above case.

SUMMARY

An object of this invention is to provide a plate-type heat exchanger that evenly distributes an inflowing fluid to heat exchange channels in the plate-type heat exchanger.

In a plate-type heat exchanger according to this invention, a plurality of rectangular plates each provided with holes, at four corners thereof, serving as inlets or outlets for a first fluid or a second fluid are stacked, first channels through which the first fluid flows and second channels through which the second fluid flows are alternately formed between the plates, and a first stacking-direction channel serving as a channel for the first-fluid channel extending in a stacking direction is formed, the first stacking-direction channel being formed of a plurality of the holes located at identical positions at one of the four corners and extending continuously in the stacking direction, and the first stacking-direction channel being a channel from which the first fluid diverges into each of the first channels.

The plate-type heat exchanger includes a fluid distributor including a main pipe that is a primary pipe inserted into the first stacking-direction channel such that a longitudinal direction of the main pipe is aligned with the stacking direction, and that is a pipe through which the first fluid flows from an end at a front side with respective to an insertion direction thereof, the main pipe being a pipe in which a plurality of resistors that act as resistance against the first fluid flowing in the longitudinal direction from the end are sequentially arranged in the longitudinal direction from the end side; and a plurality of sub pipes that are secondary pipes configured to communicate with an interior space of the main pipe and disposed in the main pipe at positions of the respective first channels.

Because the plate-type heat exchanger according to this invention includes the fluid distributor having the main pipe and a plurality of sub pipes, the inflowing fluid can be evenly distributed to the heat exchange channels.

DETAILED DESCRIPTION

Embodiment 1

Figure 1:
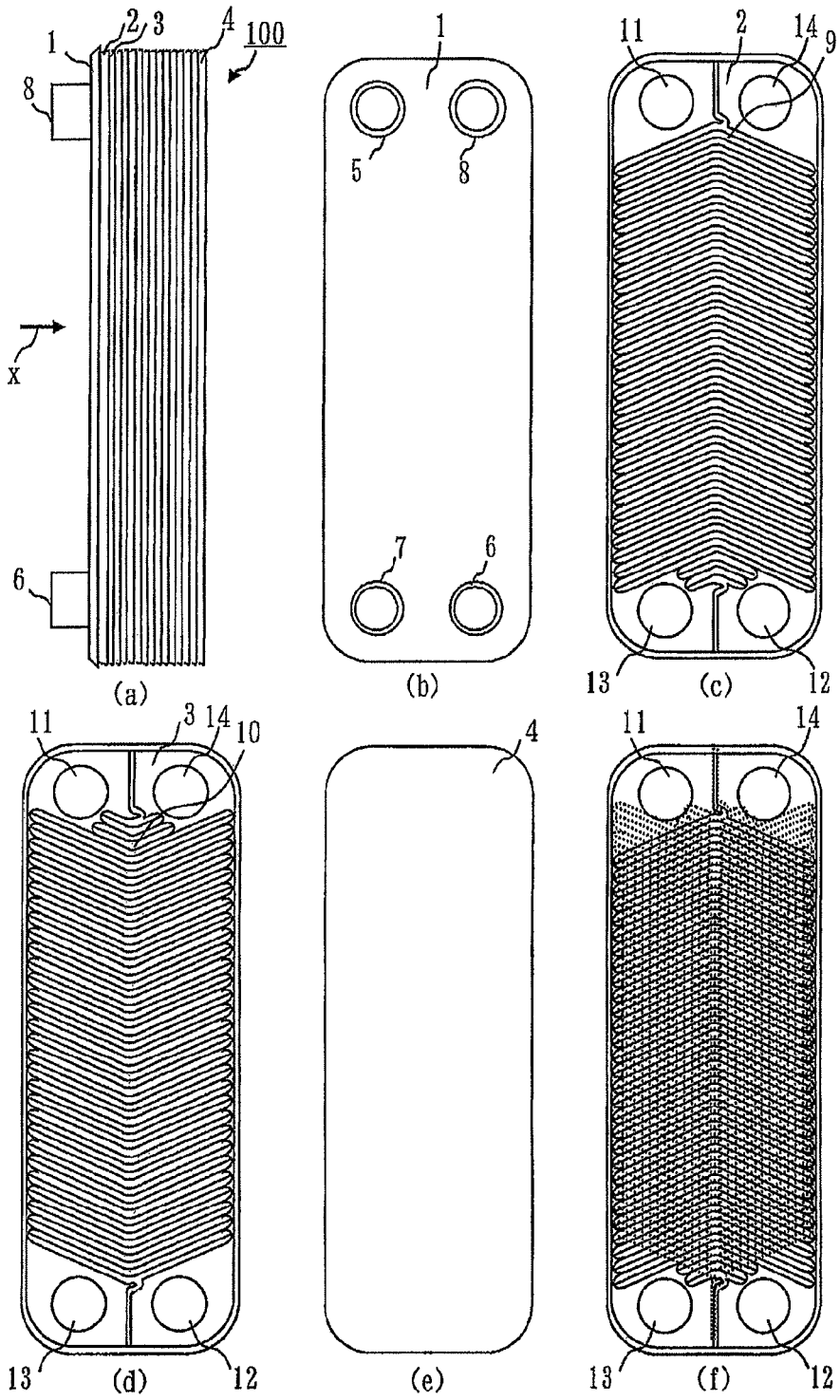
FIG. 1 illustrates a plate-type heat exchanger 100 according to Embodiment 1.

FIG. 1 illustrates a plate-type heat exchanger 100 according to Embodiment 1.

(1) FIG. 1(*a*) is a side view of the plate-type heat exchanger 100.

(2) FIG. 1(*b*) is a front view (as viewed along an arrow X in (a)). The direction indicated by the arrow X in FIG. 1(*a*) corresponds to a plate stacking direction. A front-side reinforcement side plate 1 in FIG. 1(*b*) is located at an outermost side. The front-side reinforcement side plate 1 includes an inlet-outlet pipe 5 for a first fluid A, an inlet-outlet pipe 7 for the first fluid A, an inlet pipe 6 for a second fluid B, and an outlet pipe 8 for the second fluid B. The reason for referring the inlet-outlet pipe 5 for the first fluid A and the inlet-outlet pipe 7 for the first fluid A to as "inlet-output pipes" is as follows. When the plate-type heat exchanger 100 is used as an evaporator (absorber), a refrigerant (i.e., the first fluid) flows in through the inlet-outlet pipe 7 and flows out from the inlet-outlet pipe 5 in FIG. 2 to be described later. When the plate-type heat exchanger 100 is used as a condenser (radiator), the refrigerant (i.e., the first fluid) flows in through the inlet-outlet pipe 5 and flows out from the inlet-outlet pipe 7. Accordingly, the fluid flows out or flows in depending on whether the plate-type heat exchanger 100 is used as an evaporator or a condenser. Therefore, the inlet-outlet pipe 5 and the inlet-outlet pipe 7 are referred to as "inlet-outlet pipes." The second fluid B is, for example, water. The second fluid B flows into the inlet pipe 6 regardless of whether the plate-type heat exchanger 100 is used as an evaporator or a condenser. The second fluid flows out from the outlet pipe 8.

(3) FIG. 1(*c*) illustrates a front-side heat transfer plate 2 that has a V-shaped corrugated section 9 and that constitutes channels (i.e., a first channel 21 and a second channel 22 to be described later) for the first fluid A and the second fluid B. The four corners of the front-side heat transfer plate 2 are provided with holes 11 to 14 that are to serve as inlets or outlets for the first fluid A or the second fluid B.

(4) FIG. 1(*d*) illustrates a rear-side heat transfer plate 3 that has a V-shaped corrugated section 10 whose shape is inverted relative to that of the front-side heat transfer plate 2 (such that the V-shaped sections intersect with each other) and that constitutes channels for the first fluid A and the second fluid B. By alternately arranging the front-side heat transfer plates 2 and the rear-side heat transfer plates 3, the channels for the first fluid A and the second fluid B are alternately and repeatedly formed. A channel through which the first fluid A flows will be referred to as a first channel 21, and a channel through which the second fluid B flows will be referred to as a second channel 22. Specifically, by alternately arranging the front-side heat transfer plates 2 and the rear-side heat transfer plates 3, the first channels 21 and the second channels 22 are alternately formed. If it is not necessary to distinguish between the front-side heat transfer plates 2 and the rear-side heat transfer plates 3, they will simply be referred to as plates.

(5) FIG. 1(*e*) is a rear view of the plate-type heat exchanger 100 and illustrates a rear-side reinforcement side plate 4 located at an outermost side.

(6) FIG. 1(*f*) illustrates a state where the front-side heat transfer plate 2 and the rear-side heat transfer plate 3 are stacked. When viewed in the direction of the arrow X in FIG. 1(*a*) in the state where the two plates are stacked, FIG. 1(*f*) shows the shape of the front-side heat transfer plate 2, which is viewable in actuality, with a solid line, and shows the corrugated shape of the rear-side heat transfer plate 3, which is not viewable in actuality, with a dotted line.

Figure 2:
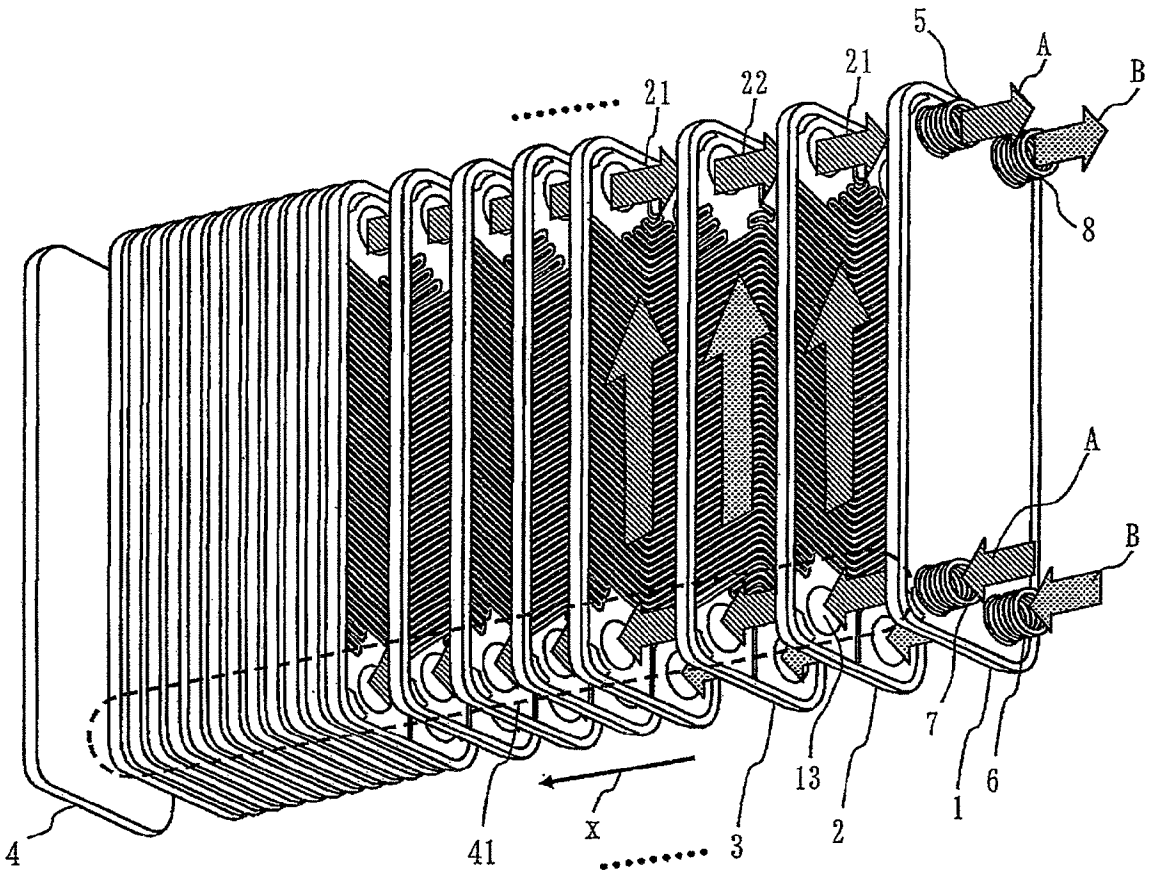
FIG. 2 is an exploded perspective view schematically illustrating the configuration of the plate-type heat exchanger 100 according to Embodiment 1.

FIG. 2 is an exploded perspective view schematically illustrating the configuration of the plate-type heat exchanger 100. In FIG. 2, a rectifier-distributor 201, to be described later, is not shown. FIG. 2 illustrates the stacked state of the plates, as well as the flow of the first fluid A and the second fluid B. FIG. 2 shows a case where the plate-type heat exchanger 100 is used as an evaporator. Therefore, the first fluid A flows in through the inlet-outlet pipe 7, flows through the first channels 21, and flows out from the inlet-outlet pipe 5. The second fluid B flows in through the inlet pipe 6, flows through the second channels 22, and flows out from the outlet pipe 8. As shown in FIG. 2, the first channels 21 through which the first fluid A flows and the second channels 22 through which the second fluid B flows are alternately formed between the plates. Moreover, a first stacking-direction channel 41 is formed. The first stacking-direction channel 41 is a first-fluid-A channel extending in the stacking direction X and is formed of a plurality of holes 13 located at identical positions at one of the four corners and extending continuously in the stacking direction X. The first fluid A diverges from the first stacking-direction channel 41 to each first channel 21.

Figure 3:
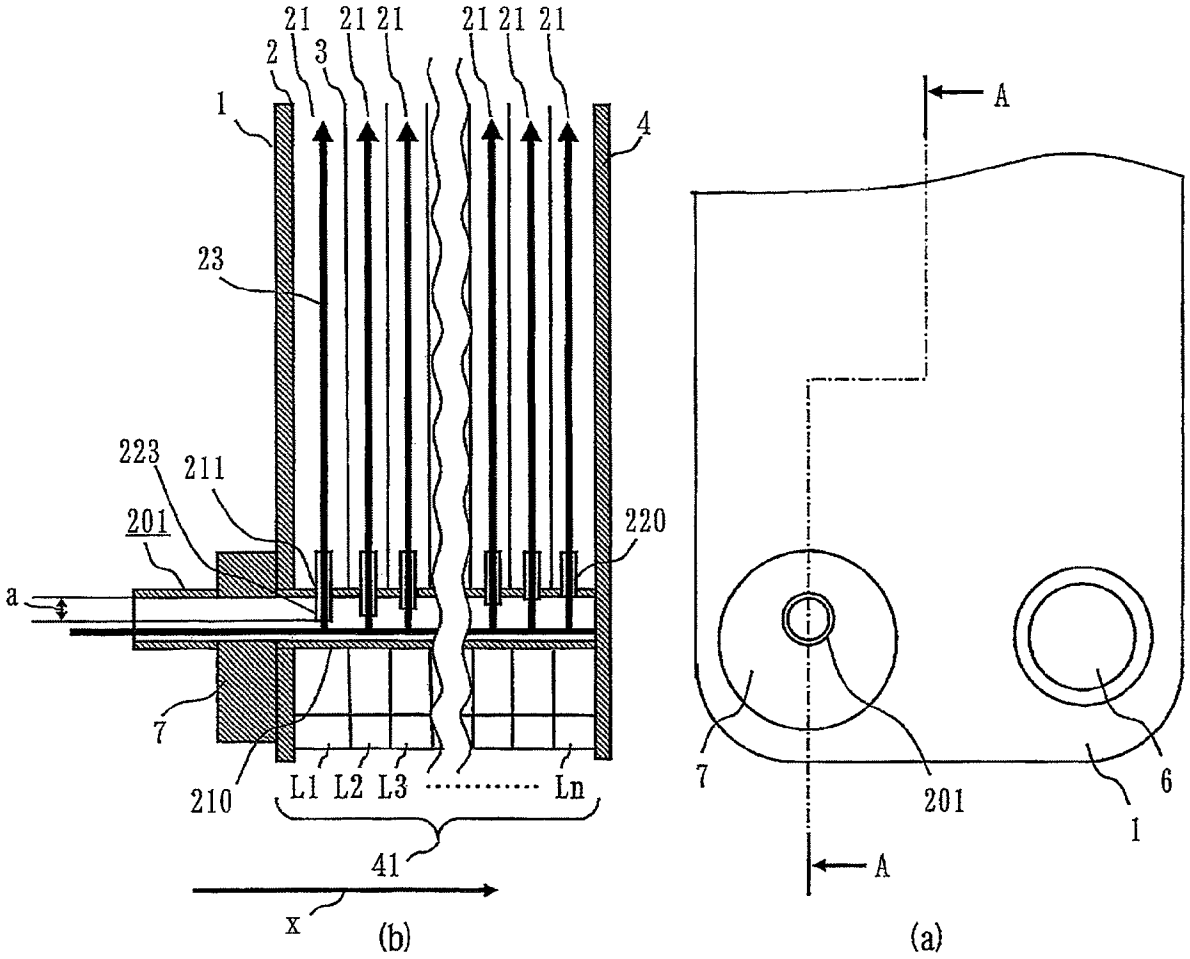
FIG. 3 illustrates a rectifier-distributor 201 according to Embodiment 1.

FIG. 3 illustrates the rectifier-distributor 201 included in the plate-type heat exchanger 100. FIG. 3(*a*) is a front view corresponding to FIG. 1(*b*) and illustrating the inlet-outlet pipe 7 and the vicinity thereof. FIG. 3(*b*) is a cross-sectional view taken along line A-A in (a). The cross-sectional view taken along line A-A is taken along a cross-sectional plane at which each first channel 21 appears to be continuous. The arrow X indicating the stacking direction extends from the front side toward the rear side. In other words, the side with the front-side reinforcement side plate 1 corresponds to the front side, whereas the side with the rear-side reinforcement side plate 4 corresponds to the rear side.

A plurality of the plates are arranged parallel to each other, and the rectifier-distributor 201 is inserted into the first stacking-direction channel 41 constituted of channels L1 to Ln based on the holes 13 in the plates. The rectifier-distributor 201 is formed by disposing a plurality of sub pipes 220 (i.e., distribution pipes) into a main pipe 210 in the direction in which the plates are arranged (i.e., the stacking direction X). The sub pipes 220 used include narrow pipes (see FIG. 5) or flat pipes 18 (see FIG. 4). With the rectifier-distributor 201, the first fluid A is evenly distributed to heat exchange channels between the plates.

Figure 4:
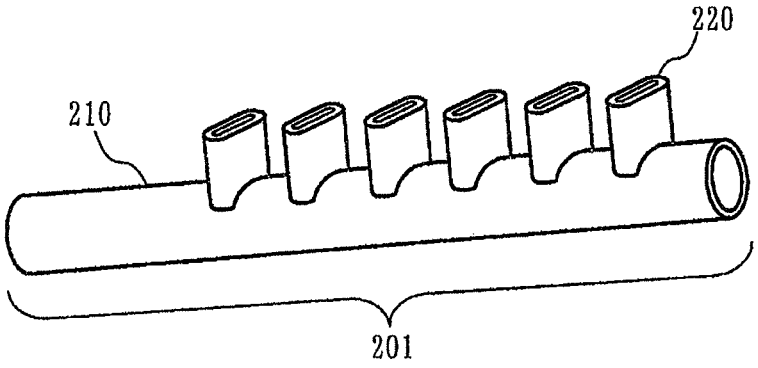
FIG. 4 illustrates the rectifier-distributor 201 according to Embodiment 1 that uses flat pipes as sub pipes 220.
Figure 11:
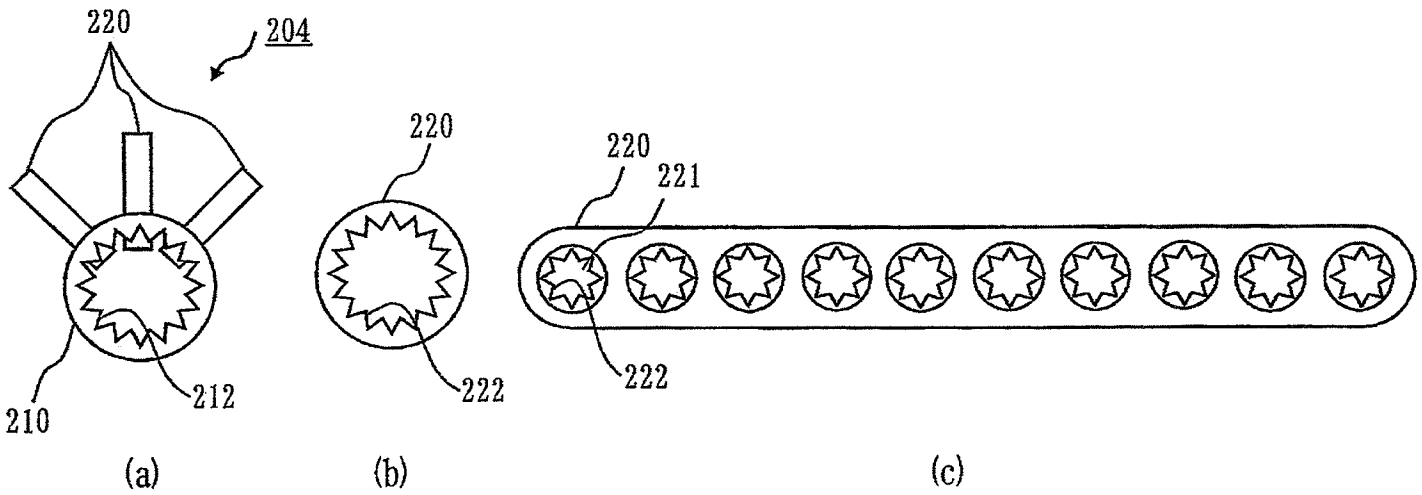
FIG. 11 illustrates grooves in the main pipe 210 and the sub pipes 220 according to Embodiment 4.

FIG. 4 illustrates the rectifier-distributor 201 that uses the flat pipes as the sub pipes 220. As shown in FIG. 11(*c*), the flat pipes each have a plurality of through-holes 221 formed substantially parallel to each other in the longitudinal direction.

Figure 5:
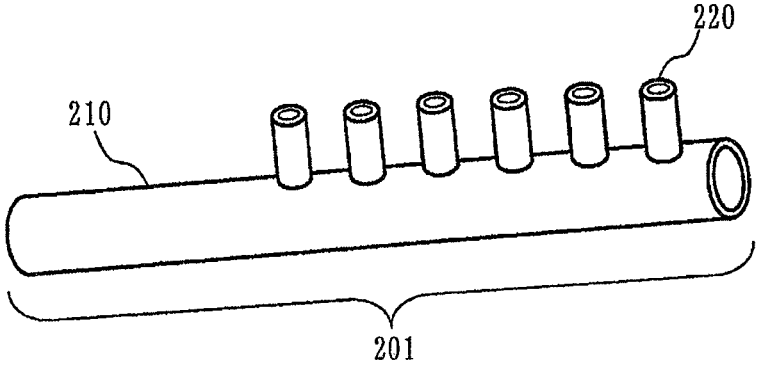
FIG. 5 illustrates the rectifier-distributor 201 according to Embodiment 1 that uses narrow pipes as the sub pipes 220.

FIG. 5 illustrates the rectifier-distributor 201 that uses hollow cylindrical narrow pipes as the sub pipes 220.

As shown in FIGS. 3 to 5, the rectifier-distributor 201 includes the main pipe 210 inserted into the first stacking-direction channel 41 such that the longitudinal direction of the main pipe 210 is aligned with the stacking direction X, and the sub pipes 220 that communicate with the interior space of the main pipe 210 and that are disposed in the main pipe 210 at the positions of the respective first channels 21. The sub pipes 220 used may be selected from at least the narrow pipes having a circular interior as shown in FIG. 5 and the flat pipes shown in FIG. 4. In other words, although the flat pipes alone are used in FIG. 4, the narrow pipes and the flat pipes may be used in a mixed fashion.

Furthermore, as shown in FIGS. 3 to 5, each of the sub pipes 220 is disposed in the main pipe 210 by inserting one end of the sub pipe 220 into a through-hole 211 extending through the main pipe 210 from the outer side surface to the inner side thereof. The one end of each sub pipe 220 protrudes as a protrusion 223 from the inner surface of the main pipe 210 to the interior space of the main pipe 210.

(Insertion Amount a)

In the related art, when there are 20 or more channels Ln in FIG. 3(*b*) (equivalent to 40 or more plates), the distribution of the first refrigerant A (i.e., first fluid) to the first channels 21 tends to deteriorate. Specifically, due to inertial force, a liquid flows more toward the rear side in the arrangement direction (i.e., toward the rear-side reinforcement side plate 4) but less toward the front side (i.e., toward the front-side reinforcement side plate 1), resulting in unevenness. However, in the rectifier-distributor 201 according to Embodiment 1, the ends of the sub pipes 220 constituted of narrow pipes or flat pipes are inserted into the main pipe 210 so as to serve as the protrusions 223. The liquid distribution in the arrangement direction (i.e., the stacking direction) can be adjusted based on the insertion amount a (i.e., a protruding length of each protrusion 223) of the protrusion 223 of each sub pipe 220 in the interior space of the main pipe 210. Specifically, each protrusion 223 acts as resistance against the first refrigerant A flowing in the longitudinal direction from the front end (i.e., the end at the front-side reinforcement side plate 1 side) of the main pipe 210. In this case, by adjusting the insertion amount a of each protrusion 223, the resistance against the first refrigerant A can be increased or decreased. As shown in FIG. 3(*b*), the insertion amount a corresponds to a dimension a by which the end of each sub pipe 220 protrudes into the interior space of the main pipe 210 from the inner surface of the main pipe 210. FIG. 3(*b*) illustrates the insertion amount a of the sub pipe 220 located at the front-most side. For example, as shown in FIG. 3(*b*), when a liquid flows toward the rear side in the arrangement direction, the sub pipes 220 at the front side may be set to have a large (long) insertion amount a, and the insertion amount a may be decreased (shortened) toward the rear side. Accordingly, the insertion amounts a of the protrusions 223 are uneven. The term "uneven" refers to a state where the insertion amounts a of the protrusions 223 are not uniform. In other words, the insertion amounts a are "uneven" except for when the insertion amounts a of all of the protrusions 223 are substantially set equal to each other. Depending on the adjustment of the amount of liquid, the insertion amounts a of the sub pipes 220 at the front side may be reduced, or the insertion amounts a at the front side and the rear side may be increased.

Accordingly, the insertion amount a of each sub pipe 220 is set in accordance with the amount of liquid or the flow pattern of the fluid flowing into the main pipe 210.

(Type of Sub Pipes)

Examples of the flat pipe used as each sub pipe 220 include an elliptical pipe, a plate-like flat pipe, an electric welded pipe, a connected pipe formed by connecting a plurality of circular pipes, and a pipe formed into a flat shape by flattening a circular pipe. In other words, the flat pipes include any type of pipes that are flat in cross section and can distribute the first refrigerant to the first channels 21 from the interior space of the main pipe 210.

As shown in FIG. 3(*b*), the sub pipes 220 each have a protruding shape. The term "protruding shape" used here means that the sub pipes 220 protrude from the outer surface of the main pipe 210 toward the first channels 21 between the plates. Due to this "protruding shape," positioning between the sub pipes 220 and the first channels 21 corresponding to the sub pipes 220 is facilitated. Specifically, when brazing is to be performed after a tentative assembly process, deformation occurs more or less during the brazing process. However, even when some deformation occurs, each sub pipe 220 is prevented from moving toward the first channels adjacent to the corresponding first channel owing to the "protruding shape." In contrast, with a configuration in which only "holes or slits" (referred to as "recessed shape") are formed in the main pipe 210, there is a possibility that the "holes or slits" and the corresponding first channels may deviate from each other due to deformation occurring during the brazing process. When this deviation occurs, the first fluid A flowing out from the "holes or slits" would strike the plates, thus making it impossible to achieve even distribution to the first channels. Furthermore, with the configuration in which only "holes or slits" are formed in the main pipe 210, if there is a certain distance between the "holes or slits" and the first channels, there is a possibility that the first fluid may not reach the channels between the plates due to the first fluid losing speed when the flow rate thereof is low. Since the sub pipes 220 have a protruding shape in the rectifier-distributor 201, the problems existing in the configuration with the "holes or slits" (recessed shape) do not occur.

(Resistors)

Figure 6:
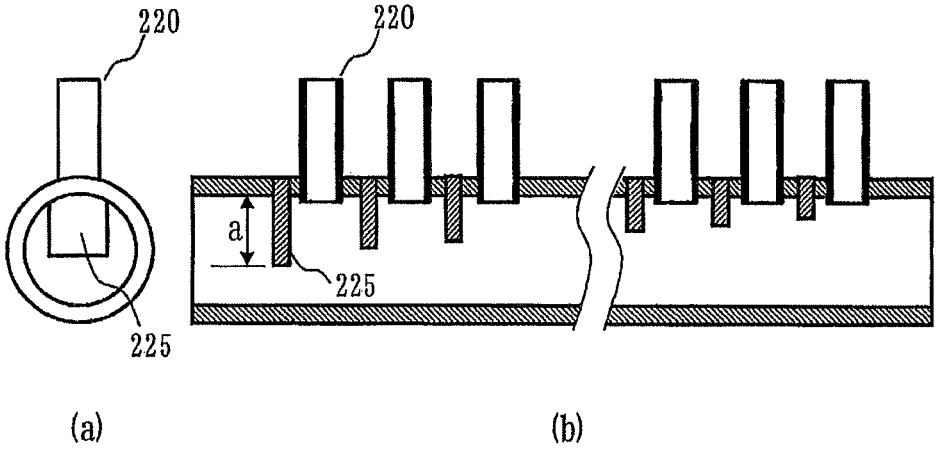
FIG. 6 illustrates a state where a plurality of resistors 225 are disposed in a main pipe 210 according to Embodiment 1.

FIG. 6 illustrates a state where a plurality of resistors 225 are disposed in the main pipe 210. FIG. 6(*a*) is a diagram of the main pipe 210 having the resistors 225 disposed therein, as viewed in the X direction (FIG. 1(*a*)). FIG. 6(*b*) is a cross-sectional view corresponding to FIG. 3(*b*). In the above description, the protrusion 223 (insertion amount a) of each sub pipe 220 functions as resistance against the first refrigerant A flowing from the front end (i.e., the end at the front-side reinforcement side plate 1 side) toward the rear side (i.e., toward the rear-side reinforcement side plate 4), as shown in FIG. 3(*b*). However, FIG. 3(*b*) is merely an example. As shown in FIG. 6, the plurality of resistors 225 may be sequentially arranged inside the main pipe 210 from the front side toward the rear side of the main pipe 210. It can be conceived that the example in FIGS. 3 to 5 is equivalent to an example where the protrusions 223 of the sub pipes 220 function as the plurality of resistors 225 in FIG. 6.

(Flat Shape)

Figure 7:
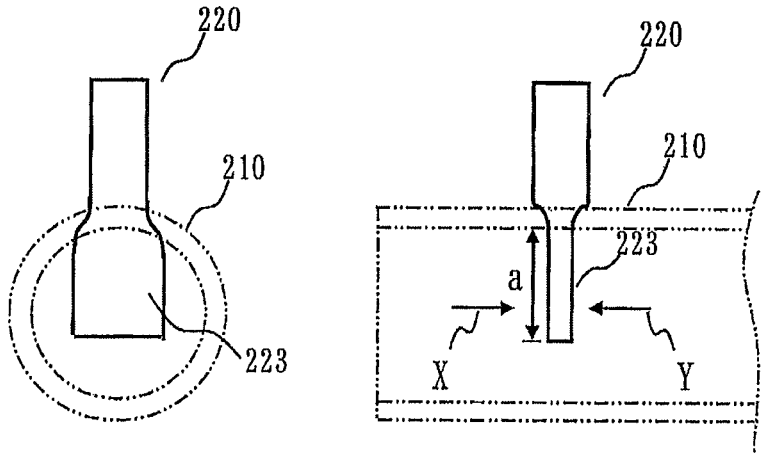
FIG. 7 illustrates a case where only a protrusion 223 of each sub pipe 220 is formed into a flat shape, in accordance with Embodiment 1.

FIG. 7 illustrates a case where only the protrusion 223 of each sub pipe 220 is formed into a flat shape. FIG. 7(*a*) corresponds to FIG. 6(*a*), and FIG. 7(*b*) corresponds to FIG. 6(*b*). FIG. 7(*b*) is not a cross-sectional view. Although Embodiment 1 is described above with reference to a case where the flat pipes, which all have a flat shape, are used as the sub pipes 220, as shown in FIG. 4, this is merely an example. As shown in FIG. 7, in each sub pipe 220, at least the protrusion 223 thereof may be formed into a flat shape. As shown in FIG. 7(*b*), the protrusion 223 is formed into a flat shape that is equivalent to a shape obtained by squeezing the protrusion 223 from two directions, that is, an insertion direction X of the main pipe 210 and an opposite direction Y from the insertion direction of the main pipe 210. Based on the insertion amount a of each of these protrusions 223, the resistance against the first refrigerant A is adjusted. It is needless to say that the sub pipes 220 may be entirely formed into a flat shape, as in FIG. 4.

(Projected Area)

When a flat shape is to be employed for each of the protrusions 223, the size of the area of the flat shape projected toward a plane with the stacking direction X (FIG. 3(*b*)) acting as the normal may be changed in addition to the insertion amount a. Specifically, when this is described in correspondence with FIG. 3(*b*), the projected area of the flat shape may be increased (widened) for the protrusions 223 at the front side and be decreased (narrowed) for those at the rear side.

In the rectifier-distributor 201 according to Embodiment 1, the sub pipes 220 are formed into the aforementioned protruding shape. Thus, the sub pipes 220 can be substantially aligned with the channels formed between the plates, or the first fluid A can be aligned with these channels. Therefore, the first fluid A can be reliably distributed to the first channels. Furthermore, as described above, the positioning between the first channels 21 and the sub pipes 220 corresponding thereto is facilitated during the assembly process of the rectifier-distributor 201.

Moreover, with the even distribution of the fluid by the rectifier-distributor 201, freeze resistance is improved. Due to inertial force, the channels formed between the plates located toward the front side of the main pipe 210 do not receive much liquid but receive vapor, which flows at high speed. Therefore, evaporation accelerates in these channels and causes the plates to decrease in temperature drastically, thus resulting in freezing. With the rectifier-distributor 201 according to Embodiment 1, the fluid in the main pipe 210 can be evenly distributed by adjusting the insertion amounts a of the sub pipes 220, thereby suppressing the occurrence of freezing. In addition, with the rectifier-distributor 201, the heat exchanging performance is enhanced so that the number of plates required in the heat exchanger for the required capacity of an air-conditioning apparatus can be minimized. Moreover, since the occurrence of freezing within the heat exchanger is suppressed, a low-cost highly-reliable plate-type heat exchanger can be provided.

Embodiment 2

Embodiment 2 will now be described with reference to FIGS. 8 and 9. In Embodiment 2, a plurality of sub pipes 220 are disposed at the position of each first channel.

In Embodiment 1, the plate-type heat exchanger 100 equipped with the rectifier-distributor 201 inserted into the first stacking-direction channel 41 is described. The rectifier-distributor 201 according to Embodiment 1 has a configuration in which the sub pipes 220 are inserted and arranged in the arrangement direction of the plates.

In Embodiment 2, at the position of each of the sub pipes 220 arranged in the arrangement direction of the plates, a plurality of sub pipes 220 are inserted into the main pipe 210 and are arranged in the circumferential direction thereof.

Figure 8:
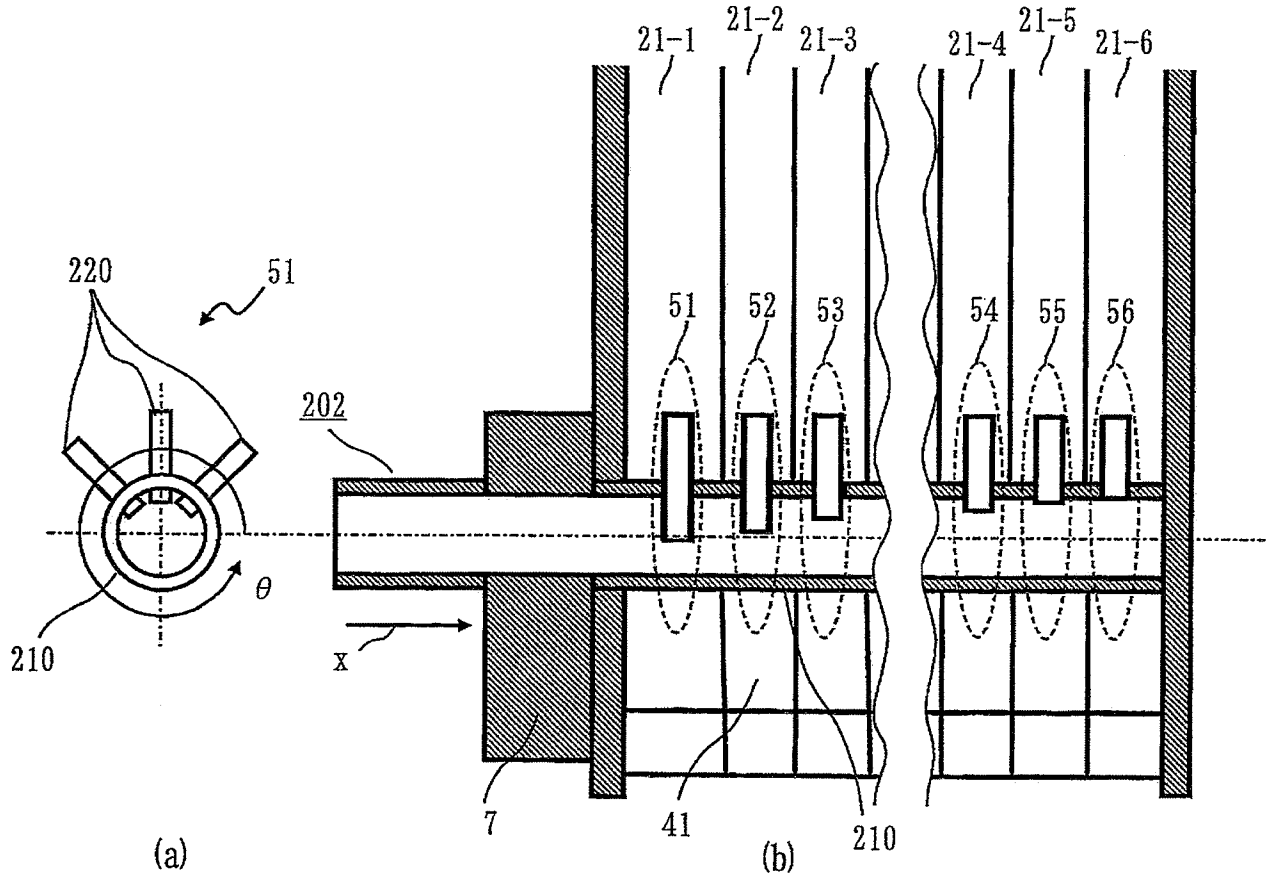
FIG. 8 illustrates a rectifier-distributor 202 according to Embodiment 2.

FIG. 8 illustrates a rectifier-distributor 202 according to Embodiment 2.

Figure 9:
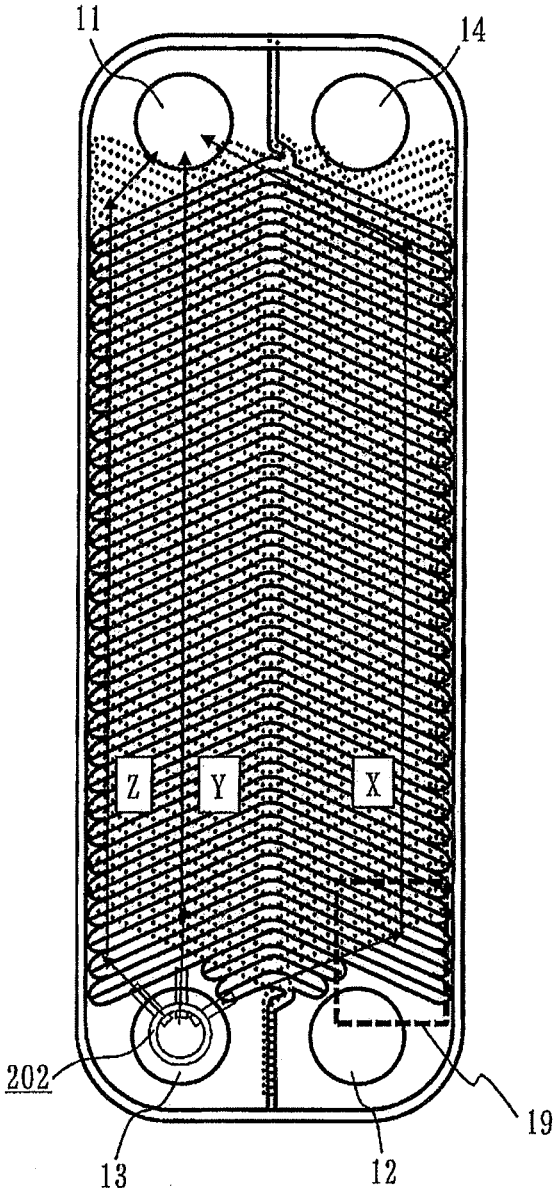
FIG. 9 illustrates the advantages of the rectifier-distributor 202 according to Embodiment 2.

FIG. 9 illustrates the advantages of the rectifier-distributor 202.

FIG. 8(*b*) is a cross-sectional view corresponding to FIG. 3(*b*). FIG. 8(*a*) is a diagram of the rectifier-distributor 202, as viewed in the direction indicated by the arrow X. At the position of each sub pipe 220, a plurality of sub pipes 220 are inserted into the main pipe 210 and are arranged in the circumferential direction of the main pipe 210. Specifically, at position 51 of the sub pipe 220 corresponding to a first channel 21-1 in FIG. 8(*b*), three sub pipes 220 are inserted into the main pipe 210 and are arranged in the circumferential direction thereof, as shown in (a). At position 52 of the sub pipe 220 corresponding to a first channel 21-2, three sub pipes 220 are inserted in a manner similar to those at position 51. The same applies to the remaining positions 53 to 56. As shown in FIG. 8(*b*), a plurality of sub pipes 220 are arranged substantially in the circumferential direction of the main pipe 210 at the position of each first channel.

Accordingly, with a plurality of sub pipes 220 inserted into the main pipe 210 and arranged in the circumferential direction thereof, the first fluid A flowing through the main pipe 210 can be spread in the circumferential direction of the main pipe 210. Since the sub pipes 220 (distribution pipes) are formed of narrow pipes or flat pipes in the rectifier-distributor 202, pressure loss of the first fluid A and the direction thereof can be readily adjusted. This will be described with reference to FIG. 9. For example, in FIG. 9, the lengths of paths X to Z for the first fluid A are in the following order: X>Z>Y. The pressure loss also decreases in this order. Thus, pressure distribution occurs within each first channel. In this case, the pressure loss can be adjusted by changing the size or the inner diameter of the sub pipes 220 or by changing the number thereof at each position (such as position 51 and position 52).

In the rectifier-distributor 202, the inner diameter of each flat pipe having a plurality of holes (FIG. 11(*c*)) can be changed, or the flowing direction of the first fluid A can be adjusted based on an insertion angle θ (FIG. 8(*a*)) in the circumferential direction. With these adjustments, the fluid can be made to flow forcedly toward the hole 12 and an area 19 (FIG. 9) at the opposite side in the short-axis direction, where the fluid tends to stagnate.

Accordingly, since stagnation of the fluid can be suppressed, the heat exchanging amount increases due to an increase in an effective heat transfer area, so that a difference in speed between the area where the fluid flows and the stagnation area is reduced, whereby pressure loss can also be reduced. The number of sub pipes 220 in the arrangement direction, the number of sub pipes 220 in the circumferential direction, or the size of the sub pipes 220 may be changed in accordance with the type of fluid, the flow pattern in the main pipe 210, the shape of the heat transfer plates, and the positions of the fluid inlets and outlets in the heat transfer plates.

Embodiment 3

Embodiment 3 will now be described with reference to FIG. 10. In the rectifier-distributor 202 according to Embodiment 2 described above, a plurality of sub pipes 220 are inserted into the main pipe 210 and are arranged in the circumferential direction thereof. In a rectifier-distributor 203 according to Embodiment 3, the main pipe 210 has a predetermined diameter (inner diameter).

Figure 10:
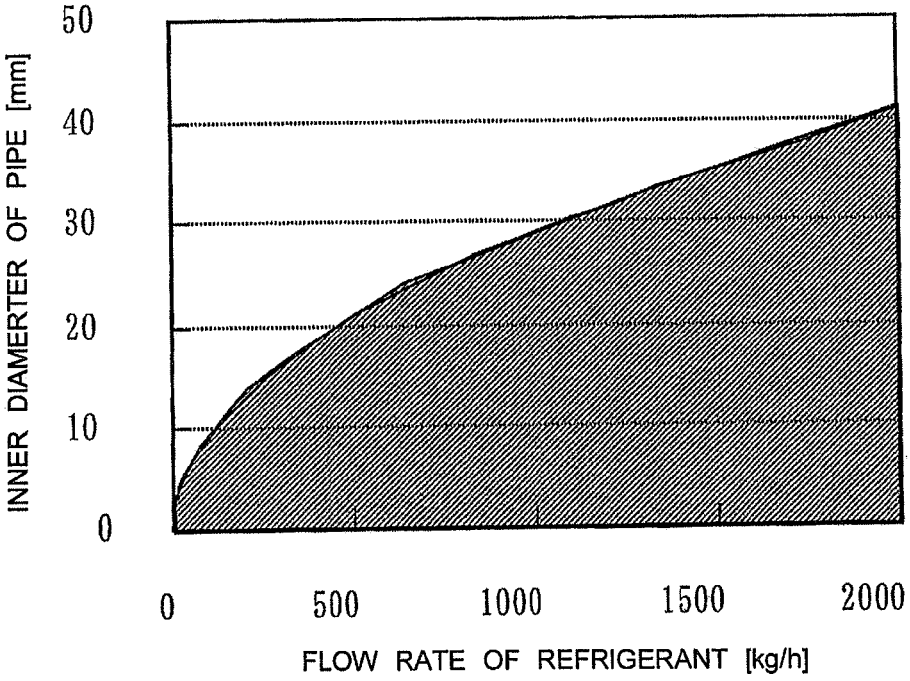
FIG. 10 illustrates the relationship between the flow rate of a refrigerant flowing into the main pipe 210 and the inner diameter of the main pipe 210 according to Embodiment 3.

FIG. 10 is a graph illustrating the relationship between the flow rate (horizontal axis; kg/h) of a refrigerant flowing into the main pipe 210 and the inner diameter (vertical axis; mm) of the main pipe 210 of the rectifier-distributor 203. Generally, the hole 13 in each heat transfer plate has a larger inner diameter and tends to form a separated flow. In the case of a separated flow, the gas and the liquid becomes uneven in the channels between the plates, causing the effective heat transfer area to decrease or freezing to occur. For example, in a case where a fluid is R410A, the flow pattern in the main pipe 210 becomes an annular flow in the inner-diameter region indicated by diagonal lines in FIG. 10, thus causing a liquid layer of the fluid to form around the pipe. The main pipe 210 of the rectifier-distributor 203 has an inner diameter that causes the inflowing first fluid A to form an annular flow. Therefore, a fluid containing an even mixture of gas and liquid can readily flow through the channels between the plates. Thus, a highly-reliable heat exchanger that not only achieves enhanced heat exchanging performance but also prevents the occurrence of freezing can be provided.

Although R410A is described above, the refrigerant is not limited to this type and may include a low GWP refrigerant, such as an HC-based refrigerant, a natural refrigerant, or an R1234yf refrigerant, in addition to a fluorocarbon refrigerant used in the related art, by adjusting the inner diameter of the main pipe 210 to a predetermined inner diameter. Furthermore, when used in combination with the configurations described in Embodiment 1 and Embodiment 2, the flow rate toward each channel can be finely adjusted by adjusting the insertion amount a of each sub pipe 220 into the main pipe 210, the size or the inner diameter of the sub pipes 220 toward the channels, and the number of sub pipes 220 arranged in the circumferential direction or the arrangement direction. Therefore, the first fluid A can be advantageously distributed more evenly.

Embodiment 4

A rectifier-distributor 204 according to Embodiment 4 will now be described with reference to FIG. 11. In the rectifier-distributor 203 according to Embodiment 3 described above, the main pipe 210 has a predetermined diameter (inner diameter). In the rectifier-distributor 204 according to Embodiment 4, the inner surface of each of the main pipe 210 and the sub pipes 220 is provided with grooves extending in the longitudinal direction.

FIG. 11 illustrates the grooves in the main pipe 210 and the sub pipes 220 according to Embodiment 4. FIG. 11(*a*) is a diagram (corresponding to FIG. 8(*a*)) of the rectifier-distributor 204 according to Embodiment 4, as viewed in the direction indicated by the arrow X. The inner surface of the main pipe 210 is provided with a plurality of grooves 212 extending in the longitudinal direction. FIG. 11(*b*) illustrates narrow pipes used as the sub pipes 220. FIG. 11(*c*) illustrates flat pipes used as the sub pipes 220. The inner surface of each of these sub pipes 220 is provided with a plurality of grooves 222 extending in the longitudinal direction. Although a plurality of sub pipes 220 are used, the sub pipes 220 may all be provided with the grooves 222, or only one or more of the sub pipes 220 may be provided with the grooves 222.

With the grooves formed in the main pipe 210 and the sub pipes 220 of the rectifier-distributor 204, a liquid is advantageously retained between the grooves and a centrifugal force is increased due to twisting of the grooves, whereby the first fluid A can readily form an annular flow. Thus, advantages similar to those in Embodiment 3 can be achieved. When used in combination with the configurations described in Embodiment 1 and Embodiment 2, the flow rate toward each channel can be finely adjusted, thereby advantageously achieving more even distribution.

Embodiment 5

In Embodiment 4 described above, the inner surfaces of the main pipe 210 and the sub pipes 220 of the rectifier-distributor 204 are provided with grooves. In Embodiment 5, a refrigeration cycle apparatus equipped with the plate-type heat exchanger 100 including any one of the rectifier-distributors 201 to 204 according to Embodiment 1 to Embodiment 4 will be described.

The refrigeration cycle apparatus according to Embodiment 5 includes a compressor, a condenser, an expansion valve, and an evaporator (radiator) that are sequentially connected by a refrigerant pipe. In the refrigeration cycle apparatus, the plate-type heat exchanger including the rectifier-distributor according to any one of Embodiment 1 to Embodiment 4 is used as at least one of the condenser and the evaporator. With the refrigeration cycle apparatus according to Embodiment 5, a highly-reliable refrigeration cycle apparatus with high heat exchanging performance can be achieved.

The refrigeration cycle apparatus is described as an application example of the plate-type heat exchanger 100 including the rectifier-distributor according to any one of Embodiment 1 to Embodiment 4. However, the plate-type heat exchanger 100 can be used in many types of industrial or domestic apparatuses equipped with a plate-type heat exchanger, such as an air-conditioning apparatus, a power generating apparatus, and a thermal sterilization apparatus for food. With an air-conditioning apparatus equipped with the plate-type heat exchanger 100, power consumption can be reduced, and $CO_2$ emission can also be reduced. Moreover, because fluid pressure loss can be reduced, a fluid with large pressure loss, such as hydrocarbon or a low GWP refrigerant, can also be used.

The plate-type heat exchanger 100 described in each Embodiment includes any one of the rectifier-distributors 201 to 204.

(1) Accordingly, heat exchange between the first fluid A and the second fluid B is uniformly performed at the channels, whereby the effective heat transfer area can be utilized without waste. Therefore, a heat exchanger with high heat exchanging efficiency can be provided.

(2) Although freezing occurs when there is more vapor in each channel, the occurrence of freezing can be suppressed due to even distribution of the liquid, thereby preventing the heat exchanger from being damaged due to freezing.

(3) The distribution pipes for distributing the fluid between the plates are circular pipes or substantially flat pipes and have a protruding shape. Therefore, the fluid can be made to flow out to the inlets of the channels between the plates. Thus, positional adjustment between the sub pipes 220 (i.e., the distribution pipes) and the channels is facilitated, whereby heat exchangers with stable quality can be produced even when they are manufactured by, for example, brazing.

(4) With an air-conditioning apparatus equipped with the plate-type heat exchanger 100, power consumption can be reduced, and $CO_2$ emission can also be reduced. Therefore, a low-cost highly-reliable refrigeration cycle apparatus or air-conditioning apparatus can be provided.

The invention claimed is:

1. A plate heat exchanger, comprising:

a plurality of rectangular plates that are each provided with holes at four corners of each of the plurality of rectangular plates, the plurality of rectangular plates are stacked along the holes to form inlets or outlets for a first fluid and a second fluid, first channels through which the first fluid flows and second channels through which the second fluid flows are alternately formed between the plates, the first channels include first channel inlets, and a third channel for the first fluid extending in a substantially perpendicular direction relative to the first channels, the third channel being formed of a plurality of the holes located at identical positions at one of the four corners and extending continuously in the substantially perpendicular direction relative to the first channels, and the first fluid diverges from the third channel into each of the first channels; and a fluid distributor including, a first pipe inserted into the third channel such that a longitudinal direction of the first pipe is aligned with the substantially perpendicular direction relative to the first channels, and the first fluid flows from a first end located at one inlet of the inlets or outlets for the first fluid, a plurality of resistors located inside the first pipe, the plurality of resistors acting as resistance against the first fluid flowing in the longitudinal direction of the first pipe from the first end and being sequentially arranged from the first end to a second end of the first pipe, the second end being located in the longitudinal direction of the first pipe at a position downstream from the first end, and a plurality of second pipes that are configured to communicate with an interior space of the first pipe, that are disposed in the first pipe at positions of the respective first channels, and that extend into the first channel inlets of the first channels to fluidly connect the plurality of second pipes and the first channels, wherein the plurality of resistors are configured such that lengths of the plurality of resistors protruding from an inner surface of the first pipe toward the interior space of the first pipe decrease as a distance extends further away from the first end in the longitudinal direction of the first pipe, wherein the first fluid flows out of the plurality of second pipes through the first channel inlets and into the first channels when the plate heat exchanger serves as an evaporator, and the first fluid flows out of the first channels through the first channel inlets and into the plurality of second pipes when the plate heat exchanger serves as a condenser.

2. The plate heat exchanger of claim 1, wherein one end of each of the plurality of second pipes is inserted into a hole formed in the first pipe so as to be disposed in the first pipe, and the one end protrudes as a protrusion from the inner surface of the first pipe toward the interior space of the first pipe, and wherein the protrusions of the second pipes constitute the plurality of resistors.

3. The plate heat exchanger of claim 2, wherein at least one of the plurality of resistors is configured such that at least the protrusion of the at least one of the plurality of resistors is formed into a flat shape that is equivalent to a shape obtained by squeezing the protrusion from two directions, which are the longitudinal direction of the first pipe and an opposite direction therefrom, and an even portion is provided so as to oppose a direction in which the first fluid flows.

4. The plate heat exchanger of claim 3, wherein each of the second pipes is a flat pipe having a plurality of through-holes, the plurality of through-holes being formed substantially parallel to each other, and each of the second pipes forms the plurality of resistors as the flat pipe.

5. The plate heat exchanger of claim 2, wherein, at the position of each first channel, the first pipe has a plurality of the second pipes arranged substantially in a circumferential direction of the first pipe at the position of each of the first channels.

6. The plate heat exchanger of claim 2, wherein a predetermined amount of the first fluid flows into the first pipe from the first end, and the first pipe has an inner diameter that allows the predetermined amount of the first fluid to flow through the first pipe from the first end and that causes the first fluid corresponding to the predetermined amount flowing in from the first end to form an annular flow.

7. The plate heat exchanger of claim 2, wherein the inner surface of the first pipe is provided with a plurality of grooves extending in the longitudinal direction of the first pipe.

8. The plate heat exchanger of claim 2, wherein an inner surface of at least one of the plurality of second pipes is provided with a plurality of grooves extending in a longitudinal direction of the second pipes.

9. The plate heat exchanger of claim 1, wherein an insertion amount of the plurality of second pipes, an inner diameter of the second pipes, and the number of the plurality of second pipes arranged in a circumferential direction of the first pipe are set to achieve annular flow of the first fluid through the first pipe.

10. The plate heat exchanger of claim 1, wherein the first pipe includes an outer wall that separates the interior of the first pipe from the first channels, and the plurality of second pipes extend from the interior of the first pipe through the outer wall of the first pipe and into the inlets of the first channels to fluidly connect the interior of the first pipe and the first channels.

11. A refrigeration cycle apparatus, comprising:

a compressor, a first heat exchanger, an expansion mechanism, and a second heat exchanger that are connected by a pipe;

a plate heat exchanger configured to serve as at least one of the first heat exchanger and the second heat exchanger, the plate heat exchanger including a plurality of rectangular plates that are each provided with holes at four corners of each of the plurality of rectangular plates, the plurality of rectangular plates are stacked along the holes to form inlets or outlets for a first fluid and a second fluid, first channels through which the first fluid flows and second channels through which the second fluid flows are alternately formed between the plates, the first channels include first channel inlets, and a third channel for the first fluid extending in a substantially perpendicular direction relative to the first channels, the third channel being formed of a plurality of the holes located at identical positions at one of the four corners and extending continuously in the substantially perpendicular direction relative to the first channels, and the first fluid diverges from the third channel into each of the first channels, and a fluid distributor including a first pipe inserted into the third channel such that a longitudinal direction of the first pipe is aligned with the substantially perpendicular direction relative to the first channels, and the first fluid flows from a first end located at one inlet of the inlets or outlets for the first fluid, a plurality of resistors located inside the first pipe, the plurality of resistors acting as resistance against the first fluid flowing in the longitudinal direction of the first pipe from the first end and being sequentially arranged from the first end to a second end of the first pipe, the second end being located in the longitudinal direction of the first pipe at a position downstream from the first end, and a plurality of second pipes that are configured to communicate with an interior space of the first pipe, that are disposed in the first pipe at positions of the respective first channels, and that extend into the first channel inlets of the first channels to fluidly connect the plurality of second pipes and the first channels, wherein the plurality of resistors are configured such that lengths of the plurality of resistors protruding from an inner surface of the first pipe toward the interior space of the first pipe decrease as a distance extends further away from the first end in the longitudinal direction of the first pipe, wherein the first fluid flows out of the plurality of second pipes through the first channel inlets and into the first channels when the plate heat exchanger serves as an evaporator, and the first fluid flows out of the first channels through the first channel inlets and into the plurality of second pipes when the plate heat exchanger serves as a condenser.

12. A plate heat exchanger, comprising:

a plurality of plates in which a plurality of holes are provided, a plurality of first channels and a plurality of second channels are alternately formed by stacking each of the plates so as to oppose each other such that a first fluid flows at a first surface side of each of the first channels that includes first channel inlets and a second refrigerant flows at a second surface side of each of the second channels;

a first pipe inserted into at least one of the plurality of holes, into which the first fluid flows from an inlet end; and a plurality of second pipes are mechanically joined to the first pipe, in which a first end is connected with an internal space of the first pipe, a second end extends through the first channel inlets to fluidly connect the plurality of second pipes to each of the plurality of the first channels, the plurality of second pipes allowing the first fluid to communicate between the first pipe and the first channels, and a plurality of resistors that provide resistance against the first fluid are disposed inside the first pipe, wherein the plurality of resistors are configured such that lengths of the plurality of resistors protruding from an inner surface of the first pipe toward the interior space of the first pipe decrease as a distance extends further away from the end at a front side in a stacking direction of the first pipe.

13. The plate heat exchanger of claim 12, wherein the plurality of resistors are protrusions provided between the plurality of second pipes.

* * * * *